United States Patent [19]

Frehn

[11] 4,198,233

[45] Apr. 15, 1980

[54] METHOD FOR THE MANUFACTURE OF TOOLS, MACHINES OR PARTS THEREOF BY COMPOSITE SINTERING

[75] Inventor: Fritz Frehn, Krefeld, Fed. Rep. of Germany

[73] Assignee: Thyssen Edelstahlwerke AG, Krefeld, Fed. Rep. of Germany

[21] Appl. No.: 898,012

[22] Filed: Apr. 20, 1978

[30] Foreign Application Priority Data

May 17, 1977 [DE] Fed. Rep. of Germany ..... 2722271

[51] Int. Cl.[2] ..... B22F 7/06

[52] U.S. Cl. ..... 75/203; 29/420.5; 75/200; 75/208 R; 75/221; 75/226; 428/565

[58] Field of Search ..... 75/203, 200, 221, 226, 75/208 R; 428/565; 24/420.5

[56] References Cited

U.S. PATENT DOCUMENTS

| | | | |
|---|---|---|---|
| 2,175,899 | 10/1939 | Kelley | 75/208 R |
| 2,313,227 | 3/1943 | De Bats | 75/208 R X |
| 2,582,231 | 1/1952 | Catallo | 428/565 X |
| 2,769,611 | 11/1956 | Schwarzkopf | 75/208 R |
| 2,899,338 | 8/1959 | Guetzel et al. | 75/208 |
| 2,950,523 | 8/1960 | Frommelt et al. | 428/565 |
| 3,010,196 | 11/1961 | Smith et al. | 75/208 R X |
| 3,165,822 | 1/1955 | Beeghly | 428/565 X |
| 3,311,507 | 3/1967 | Dittman et al. | 75/208 R |
| 3,697,261 | 10/1972 | Jump et al. | 75/208 R |
| 3,761,257 | 9/1973 | Dunn | 29/420.5 X |
| 3,836,341 | 9/1974 | Saltzman et al. | 428/547 X |
| 3,837,068 | 9/1974 | Dunn | 29/420.5 X |
| 3,999,954 | 12/1976 | Kolaska et al. | 428/547 X |
| 4,049,876 | 9/1977 | Yamamoto et al. | 428/547 |

*Primary Examiner*—Richard E. Schafer
*Attorney, Agent, or Firm*—Kenyon & Kenyon

[57] ABSTRACT

Described herein is a method for the manufacture of materials such as tools, machines or parts thereof composed of at least two sections joined together by composite sintering from sintered alloys with an iron, nickel or cobalt base wherein at least two powdered metallic mixtures having differing metal carbide contents are separately prepared and poured, one after the other, into a mold and then formed into a pressed body; the pressed body is then sintered at the lowest temperature sufficient to cause alloy formation in the mixture having the lowest sintering temperature, and then hot-pressed to complete alloy formation in the pressed body and achieve maximum density.

8 Claims, No Drawings

METHOD FOR THE MANUFACTURE OF TOOLS, MACHINES OR PARTS THEREOF BY COMPOSITE SINTERING

This invention relates to the manufacture of materials such as tools, machines or parts thereof, and more particularly, to the manufacture of these materials from at least two sintered alloys having differing amounts of metal carbides.

Alloys that are easily machined mechanically have lower metal carbide contents of about 25 to 35%. In many cases, the machinable and hardenable sintered steel alloys with embedded metal carbide, of which a multiplicity of compositions is known, for example, from the German Pat. No. 1,219,239, do not meet present day technical requirements. It is often necessary to increase the metal carbide content, primarily that of titanium carbide, which can be replaced up to 50% by one or several other carbides of the metals chromium, vanadium, niobium, tantalum and zirconium, to over 35% by weight (the machinability limit), for example to 50% by weight metal carbide. The requirement of increased metal carbide content applies only to that part of a tool, machine or post which is directly subjected to the greater wear. Adjacent parts may consist of normal, machinable hard material, and for parts which are not subject to wear, even only of tool steel or structural steel.

It is an object of the present invention to produce parts which are subjected to particularly severe wear and which exhibit, on the one hand, adequate resistance to mechanical abrasion but, on the other hand, also the necessary toughness, especially bending strength, to withstand the respective stresses. As there are no known alloys which exhibit sufficient toughness simultaneously with maximum hardness, other approaches must be taken and the parts must be made of different materials. In this manner, the material most advantageous for the respective stress can be used at every point.

This is known in principle from, for example, the German Pat. No. 2,139,738. There, a two-layer manufacturing process is proposed for a sealing element for rotating combustion engines, which is subjected to abrasion wear and bending. The part was pressed from two layers of powder into the desired shape and the pressed body was subsequently sintered. For the section of the sealing element subject to abrasion wear, a sintered steel alloy with a high metal carbide content was used, while the section not subjected to abrasion wear consisted of a sintered steel alloy with a lower metal carbide content. The compositions of the alloys were matched so that both alloys could be sintered at the same temperature in the liquid phase. This is possible, however, only if the metal carbide contents of the alloys do not differ too much from each other. This means that extremely hard, i.e., high-carbide alloys cannot be sintered together with very tough, i.e., low-carbide alloys at one and the same temperature. The technical alloying measures to equalize the sintering temperatures of the alloys, which differ from each other because of the different carbide contents, are limited.

It is therefore an object of the present invention to provide a method for the manufacture of a part from alloys, the metal carbide content of which differs more, for example, by greater than 10% by weight. The customary methods of silver soldering or diffusion welding fail if the part is mechanically stressed more severely, such as the stresses to which beater elements are subjected in crushing mills for comminuting ore or rock. Also the above mentioned composite sintering is not applicable if the deviations in the carbide content of the alloys are larger.

According to the invention, a method is now proposed for solving this problem. Thus, the present invention provides a method for the manufacture of materials such as tools, machines or parts thereof adapted to exhibit both resistance to wear and toughness and composed of a sintered composite of materials having differing quantities of metal carbide. According to the method, at least two metallic powder mixtures are prepared, each mixture comprised of a base metal of iron, nickel, cobalt or mixture thereof and having dissimilar weight contents of metal carbide. After the raw materials in powder form of the materials to be paired up are mixed, the alloy mixtures, in powder form, are shaken one after the other into a mold and pressed into a molded body in a known manner. According to the method of the invention, the molded body is sintered at the lowest sintering temperature of the pair of materials in a vacuum. In this process, the section of the pressed part which consists of the alloy which is sintered out completely at this temperature in the liquid phase, forming an alloy, becomes dense. The other section or sections which consist of alloys that sinter only a higher temperatures, are then not yet completely dense; they therefore break easily and also do not yet have the required hardness.

To correct this deficiency remaining after the sintering, it is further provided, according to the invention, to hot-press the sintered body under conditions at which alloy formation comes about in the not yet fully sintered sections and maximum density is obtained.

Hot pressing advantageously takes place in inert gas such as argon at a pressure in the range of from about 1000 to 2000 bar and at a temperature which is about 100° to 300° C. lower than the respective lowest sintering temperatures of the pair of materials.

Hot pressing per se is within the state of the art. See, for example, Kieffer-Hotop "Sintereisen und Sinterstahl" (Sintered iron and Sintered steel), 1948, page 236. More specifically, hot pressure treatment either of powders or of cold-pressed bodies or, finally, of bodies which have already been subjected to some sintering treatment is known. The proposed solution of the problem underlying the invention, however, cannot be found in the literature.

According to the invention, a combination between a metal carbide-containing sintered alloy and metal carbide-free sintered steel is also possible. For many parts subject to wear, the composite sintering of two alloys, one with about 50% by weight TiC and one with 33% by weight TiC is sufficient, where the necessary fastening means can be provided at the machinable part with the lower hardness.

The section of the alloy containing 50% by weight of carbide prevents severe wear at the bottom of the mold; the alloy with 33% by weight of metal carbide also has high wear resistance, but the carbide content is lowered to increase the toughness and prevent the edges from breaking at the tips.

For certain molds, for example, for making briquets of lignite, ore, carbides and the like, a triple combination between sintered steel, a sintered alloy with 50% by weight TiC and a further sintered alloy with 30% by weight is indicated. The briquet mold is made from the rectangular body after the composite sintering by electrochemical or spark erosion processes.

The manufacturing process will be explained with reference to the following example:

First, a powder mixture with 33% by weight titanium carbide and 67% by weight of a steel matrix consisting of 0.75% carbon, 0.8% manganese, 14.0% chromium, 3.0% molybdenum, 0.8% copper, 0.8% nickel, 0.25% vanadium, 0.02% boron and the remainder iron, is placed in a flexible rubber or plastic mold for isostatic cold pressing. About ¾ of the volume is shaken in. Then the other mixture with 50% by weight titanium carbide and the same steel matrix is added and shaken in. This charge is then densified from all sides in an isostatic cold press at about 1500 bar. A so-called pressure bond comes about between the two mixtures with 33 and 50% by weight titanium carbide. After removal from the mold, this body is subjected to vacuum sintering and the temperature is held so that the part with 33% by weight TiC sinters to maximum density. This temperature is about 1375° C.

Subsequently, the body is densified in a hot-pressing facility in argon at 1500 bar and 100° C. below the lowest sintering temperature, i.e., at 1275° C. Since in the part with a high liquid phase content the alloy formation was completed in the preceding vacuum sintering process, it can now withstand higher temperatures.

Advantages of the method according to the invention over the known manufacture of prefabricated parts and their joining by diffusion welding or silver soldering are:

- the separate fabrication of the parts with higher or reduced or no carbide content is eliminated,
- the preparation of the individual parts by planing, milling, turning and grinding for the purpose of subsequent high-temperature soldering or diffusion welding becomes unnecessary,
- weak points, such as are unavoidable in joining by silver soldering or diffusion welding in the form of faults or brittle points, are avoided and assurance is thereby provided for greater durability and safety.
- about 50% of the costs for the manufacture of composite parts with different carbide content are saved.

Examples of applications of tools or parts made in accordance with this invention are beating tools for mills of all kinds, molds for lignite, bituminous coal, ores, carbides, oxides, nitrides and the like, where maximum wear resistance and breaking strength are required; coining and forming tools, extrusion tools where high wear resistance and high bending strength must be combined; "sonotrodes" for ultrasound welding and ultrasound machining, where high wear resistance is required at the weld but high permeability for vibrations in the remaining part.

What is claimed is:

1. A method for the manufacture of tools, machines or parts thereof adapted to exhibit both resistance to wear and toughness, said method comprising:

(a) separately preparing at least two metallic powder mixtures, each mixture comprised of a base metal selected from the group consisting of iron, nickel, cobalt and mixture thereof, said mixtures having dissimilar weight contents of metal carbide;

(b) admitting said mixtures, one after the other into a mold and forming the mixtures into a pressed body;

(c) sintering said pressed body in a vacuum at the lowest temperature sufficient to cause alloy formation in the mixture having the lowest sintering temperature; and (d) hot-pressing the partially sintered pressed body of (c) to cause alloy formation in the unsintered sections thereof and thereby achieve maximum density of said pressed body.

2. The method according to claim 1 wherein first and second metallic powder mixtures are utilized, said first mixture having a metal carbide content in the range of from about 25 to about 80% by weight and said second mixture having a metal carbide content from 0% to an amount less than that of said first mixture.

3. The method according to claim 2 wherein the metal carbide content of said first mixture is from about 50% to about 80% by weight and the metal carbide content of said second mixture is from about 0 to about 33% by weight.

4. The method according to any of claims 2 or 3 wherein said metal carbide comprises titanium carbide.

5. The method according to any of claims 2 or 3 wherein said metal carbide comprises titanium carbide and one or more carbides of a metal selected from the group consisting of chromium, vanadium, niobium, tantalum and zirconium.

6. The metal according to claim 5 wherein said titanium carbide comprises at least 50% by weight of the total content of metal carbide.

7. The method according to claim 1 wherein first, second and third powder mixtures are utilized; said mixtures having, respectively, metal carbide contents in the range of about 50% to about 80%; 20% to 35%; and 0%, all percents by weight.

8. The method according to claim 1 wherein said hot-pressing takes place in an inert gas at a pressure in the range of from about 1000 to about 2000 and a temperature in the range of from about 100° to about 300° C. lower than the lowest temperature at which the mixture having the lowest sintering temperature sinters.

* * * * *